US011677127B2

(12) United States Patent
Kawaguchi

(10) Patent No.: US 11,677,127 B2
(45) Date of Patent: Jun. 13, 2023

(54) FILTER AND WIRELESS COMMUNICATION SYSTEM

(71) Applicant: KABUSHIKI KAISHA TOSHIBA, Tokyo (JP)

(72) Inventor: Tamio Kawaguchi, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 90 days.

(21) Appl. No.: 17/469,842

(22) Filed: Sep. 8, 2021

(65) Prior Publication Data

US 2022/0181758 A1 Jun. 9, 2022

(30) Foreign Application Priority Data

Dec. 7, 2020 (JP) ..... JP2020-202940

(51) Int. Cl.

| | |
|---|---|
| ***H01Q 1/22*** | (2006.01) |
| ***H01Q 1/24*** | (2006.01) |
| ***H01P 1/20*** | (2006.01) |
| ***H01P 3/12*** | (2006.01) |
| ***H01Q 19/10*** | (2006.01) |

(52) U.S. Cl.

CPC ..... *H01P 1/20* (2013.01); *H01Q 19/10* (2013.01)

(58) Field of Classification Search

CPC .. H01P 1/20; H01P 1/207; H01P 1/209; H01P 3/12; H01Q 19/10; H01Q 13/00; H01Q 1/38; H01Q 1/22; H01Q 1/24; H01Q 1/241; H01Q 21/00

See application file for complete search history.

(56) References Cited

U.S. PATENT DOCUMENTS 4,737,746 A * 4/1988 Ueno ..... H01P 1/2056 333/202
6,498,550 B1 * 12/2002 Miller ..... H01P 1/2088 333/202
9,601,820 B2 * 3/2017 Herbsommer ..... H01P 3/122
9,666,921 B2 * 5/2017 Rogozine ..... H01P 1/2002

(Continued)

FOREIGN PATENT DOCUMENTS

JP H11-274817 A 10/1999

*Primary Examiner* — Tho G Phan

(74) *Attorney, Agent, or Firm* — Finnegan, Henderson, Farabow, Garrett & Dunner, LLP

(57) ABSTRACT

A filter has a first conductive layer, a second conductive layer, and a dielectric substrate located between the first conductive layer and the second conductive layer, wherein the dielectric substrate includes a waveguide capable of propagating a radio-frequency signal in a first direction by a region between a first conductive via group passing through the dielectric substrate from the first conductive layer to the second conductive layer and spaced apart from each other along the first direction and a second conductive via group passing through the dielectric substrate from the first conductive layer to the second conductive layer and spaced apart along the first direction, and a reflective resonator that is coupled to the waveguide in an electromagnetic field and reflects a signal in a predetermined frequency band in the radio-frequency signal propagating through the waveguide, and the reflective resonator has a third conductive via group and fourth conductive vias.

20 Claims, 21 Drawing Sheets

(56) References Cited

U.S. PATENT DOCUMENTS

| | | | | |
|---|---|---|---|---|
| 11,128,023 | B2 * | 9/2021 | Ali | H01Q 1/2283 |
| 11,539,107 | B2 * | 12/2022 | Lim | H05K 1/024 |
| 2011/0001584 | A1 * | 1/2011 | Enokihara | H01P 1/2088 333/208 |
| 2022/0077554 | A1 * | 3/2022 | Tang | H01P 1/2002 |

* cited by examiner

WHEN LOSS OF USED RESONATOR AND THE NUMBER OF STAGES ARE THE SAME, NARROW BAND IS STEEPER, AND WIDE BAND IS ADVANTAGEOUS IN TERMS OF LOSS

WHEN STEEPNESS IS THE SAME, MULTISTAGING IS NECESSARY MULTISTAGING INCREASES LOSS

PASS CHARACTERISTICS OF BAND REJECTION FILTER

AiM

31a: WIRELESS COMMUNICATION DEVICE

FILTER AND WIRELESS COMMUNICATION SYSTEM

CROSS REFERENCE TO RELATED APPLICATIONS

This application is based upon and claims the benefit of priority from the prior Japanese Patent Application No. 2020-202940, filed on Dec. 7, 2020, the entire contents of which are incorporated herein by reference.

FIELD

An embodiment of the present invention relates to a filter and a wireless communication system.

BACKGROUND

It is expected that high-speed wireless communication of 5th generation mobile communication systems (hereinafter abbreviated as 5G) will rapidly spread. There is a frequency band allocated for another purpose adjacent a frequency band used for 5G, and it is therefore necessary to prevent a 5G radio signal from causing interference.

Although a frequency band of a transmitted signal from an antenna can be limited by providing a band pass filter in a wireless communication device for 5G, there is a problem that it is difficult to produce a band pass filter having steep frequency cutoff characteristics since the frequency band of 5G is wide.

Furthermore, in 5G, for example, use of an antenna in which a plurality of flat-plate-shaped patch antennas are arranged on a substrate is assumed, and therefore a small filter suitable for the size of the patch antennas is required.

DETAILED DESCRIPTION

According to one embodiment, a filter has:

a first conductive layer;

a second conductive layer; and a dielectric substrate located between the first conductive layer and the second conductive layer, wherein the dielectric substrate comprises:

a waveguide capable of propagating a radio-frequency signal in a first direction by a region between (1) a first conductive via group having first conductive vias passing through the dielectric substrate from the first conductive layer to the second conductive layer and spaced apart from each other along the first direction and (2) a second conductive via group having second conductive vias passing through the dielectric substrate from the first conductive layer to the second conductive layer and spaced apart from each other along the first direction, and a reflective resonator that is coupled to the waveguide in an electromagnetic field and reflects a signal in a predetermined frequency band in the radio-frequency signal propagating through the waveguide, and the reflective resonator comprises:

a third conductive via group having third conductive vias passing through the dielectric substrate from the first conductive layer to the second conductive layer and spaced apart from each other along a periphery of a region in contact with a defective part that is provided in a part of the first conductive via group and where no first conductive via group is provided, and one or more fourth conductive vias that pass through the dielectric substrate from the first conductive layer to the second conductive layer and are disposed in the defective part.

Hereinafter, an embodiment of a filter and a wireless communication system will be described with reference to the drawings. Although main components of the filter and the wireless communication system will be mainly described below, the filter and the wireless communication system may have components and functions that are not illustrated or described. The following description does not intend to exclude components and functions that are not illustrated or described.

Figure 1:
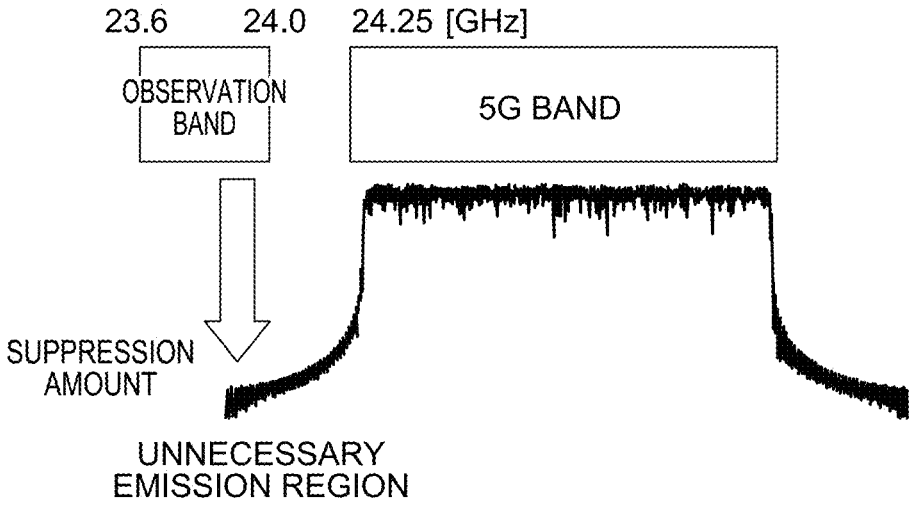
FIG. 1 is a schematic diagram of a transmission spectrum of a 5G wireless communication system.

For 5G wireless communication, a frequency band of 24 GHz to 28 GHz is allocated in addition to a frequency band near the 4 GHz band. However, a frequency band used by an earth exploration satellite has already been allocated close to 24 GHz, and it is necessary to prevent 5G wireless communication from interfering with observation of the earth exploration satellite. FIG. 1 is a diagram illustrating an example of frequency characteristics of a transmission spectrum from a 5G wireless communication system. As illustrated in FIG. 1, the transmission spectrum has unnecessary radiation to an outside of the used band, and there is a risk of interference in an adjacent frequency band.

Figure 2A:
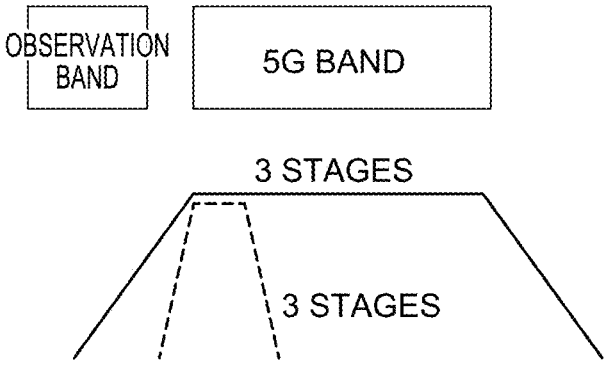
FIG. 2A is a graph comparing frequency cutoff characteristics in a case where a signal pass bandwidth of a bandpass filter is wide and frequency cutoff characteristics in a case where the signal pass bandwidth is narrow.
Figure 2B:
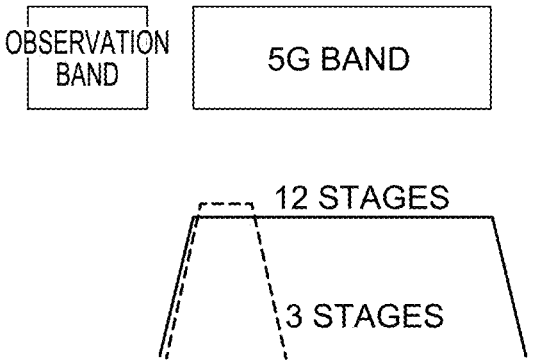
FIG. 2B is a diagram illustrating an example in which the number of stages of a bandpass filter is increased to 12 stages when a signal pass bandwidth of the bandpass filter is wide.

Frequency cutoff characteristics of a band pass filter (BPF) depend on a signal pass bandwidth. FIGS. 2A and 2B are diagrams schematically illustrating a relationship between frequency cutoff characteristics and a signal pass bandwidth. In a case where a signal pass bandwidth is wide as in 5G, it is not easy to make frequency cutoff characteristics steep, and it is necessary to make a band pass filter multistage in order to make the frequency cutoff characteristics steep. FIG. 2A is a diagram comparing frequency cutoff characteristics in a case where the signal pass bandwidth is wide (solid line) and frequency cutoff characteristics in a case where the signal pass bandwidth is narrow (broken line) in a case where the number of stages of a bandpass filter is three. As illustrated in FIG. 2A, in a case where loss of a used resonator is the same and the number of stages of the band pass filter is the same, steepness of the frequency cutoff characteristics is impaired and signal leakage is more likely to occur as the signal pass bandwidth is wider.

FIG. 2B illustrates an example in which the number of stages of the band pass filter is increased to 12 stages in a case where the signal pass bandwidth of the band pass filter is wide. By making the band pass filter multistage, the frequency cutoff characteristics can be made steep, but signal loss increases as the number of stages increases. As described above, in a case where a band pass filter is used, it is not easy to make frequency cutoff characteristics steep in a wide band and suppress signal loss.

As a measure for preventing a 5G radio signal from leaking to an adjacent frequency band, it is conceivable to use a band rejection filter (BRF) instead of a band pass filter. The band rejection filter has a function of attenuating a specific frequency band (unnecessary wave).

Figure 3:
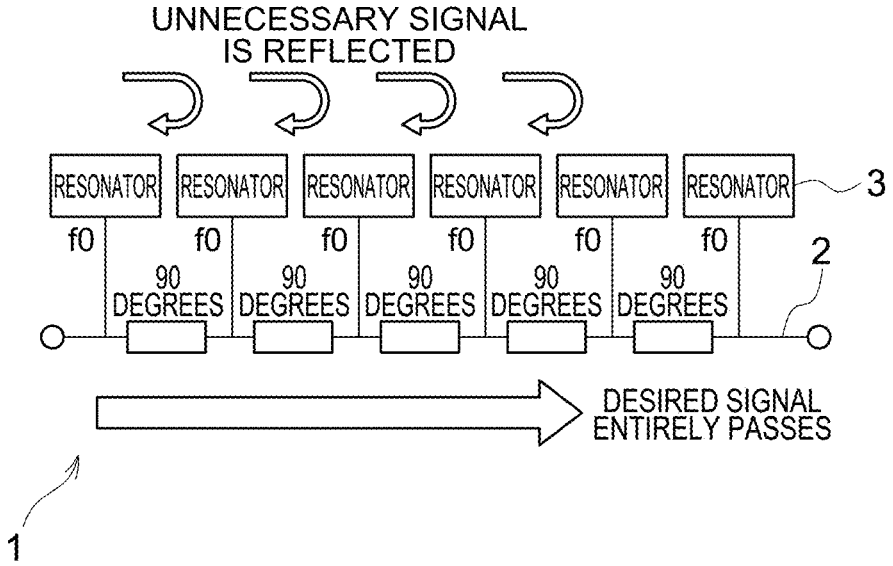
FIG. 3 is a diagram illustrating an operation principle of a band rejection filter.
Figure 4:
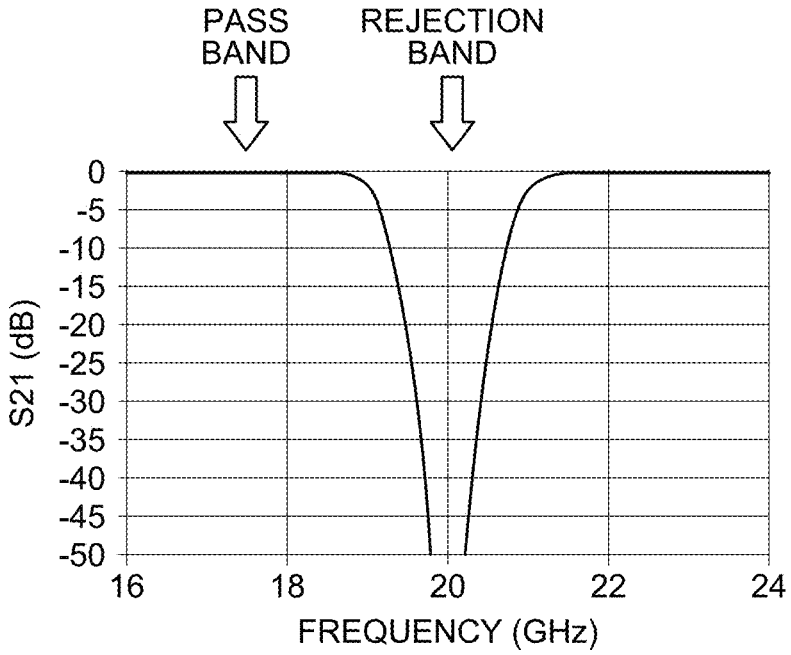
FIG. 4 is a transmission characteristic of a band rejection filter.

FIG. 3 is a diagram illustrating an operation principle of a band rejection filter 1, and FIG. 4 is a pass characteristic diagram of the band rejection filter 1. As illustrated in FIG. 3, the band rejection filter 1 includes a transmission path 2 and a plurality of resonators 3 connected to the transmission path 2 at predetermined intervals. Two adjacent resonators 3 on the transmission path 2 have a phase difference of $\lambda/4=90$ degrees, where $\pi$ is a wavelength of a signal propagating through the transmission path 2.

A signal component of a resonance frequency f0 of the resonators 3 included in the signal propagating through the transmission path 2 in FIG. 3 is reflected by the resonators 3 and returns to an input side of the transmission path 2. As a result, as illustrated in FIG. 4, only the signal component of the resonance frequency f0 can be cut off.

The band rejection filter 1 can be configured by combining various filters, and can also perform band limitation, spurious removal, and the like. Recently, there is a strong demand for a reduction in size of a communication device, and therefore it is desirable that the band rejection filter 1 achieve both a reduction in size and suppression of signal loss.

Figure 5A:
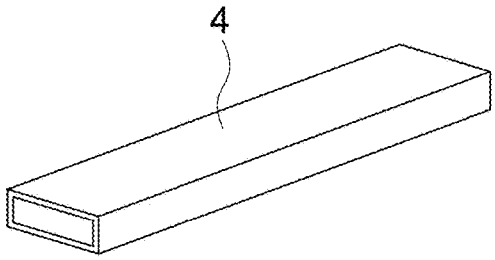
FIG. 5A is a perspective view illustrating a general waveguide.

In view of this, in the present embodiment, the band rejection filter 1 has a waveguide structure. FIG. 5A is a perspective view illustrating a general waveguide 4. The waveguide 4 illustrated in FIG. 5A is often used for high power transmission and signal transmission in a radio-frequency band such as a millimeter wave band. This is because, in a planar circuit structure having a conductive pattern on a dielectric substrate, loss of the dielectric substrate and resistance loss during signal transmission are particularly large in a millimeter wave band, and signal loss tends to be large. Since the waveguide 4 illustrated in FIG. 5A is required to have high dimensional accuracy during transmission of a radio-frequency signal, a manufacturing cost may increase. In addition, since the waveguide 4 requires a connection flange portion, the size increases. Therefore, it is technically difficult to arrange the waveguides 4 at high density.

As described above, the waveguide 4 has an advantage that signal loss can be suppressed as compared with a case where a circuit is configured by a planar circuit such as a microstrip structure or a coplanar structure, but it is difficult to reduce a size of the waveguide 4 because it is necessary to form a wall around the transmission path 2 and provide a connection flange portion. In recent wireless communication such as 5G, a reduction in size of a filter is required since an array antenna having a plurality of antenna elements is used and a filter and a transceiver are required for each antenna element.

Figure 5B:
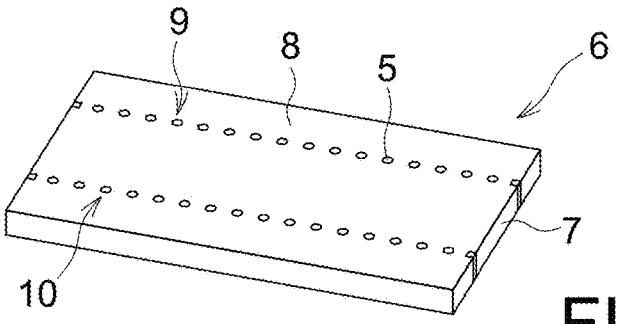
FIG. 5B is a perspective view illustrating an example of a substrate integrated waveguide structure including a plurality of conductive vias.

In view of this, in the present embodiment, a waveguide structure is formed by a plurality of conductive vias passing through a dielectric substrate having a conductive layer on two opposing surfaces thereof. FIG. 5B is a perspective view illustrating an example of a waveguide structure 6 having a plurality of conductive vias 5. The waveguide structure 6 of FIG. 5B includes conductive layers 8 disposed on respective two opposing surfaces of a dielectric substrate 7, and a plurality of conductive vias (sometimes referred to as metal posts) 5 that pass through the dielectric substrate 7 from one conductive layer 8 to the other conductive layer 8. A conductive via group 9 and a conductive via group 10 including the plurality of conductive vias 5 arranged in two rows, the dielectric substrate 7, and the conductive layers 8 constitute the waveguide structure 6. In FIG. 5B, the two conductive via groups 9 and 10 arranged in two rows act as pseudo metal walls, and form a transmission path 2 for propagating radio waves, as in a dielectric loaded waveguide. By using a material having low dielectric loss as a dielectric material of the dielectric substrate 7, the transmission path 2 having low loss in a radio-frequency band can be configured, as in the waveguide 4.

The waveguide structure 6 of FIG. 5B includes the conductive via group 9 and the conductive via group 10 constituted by the plurality of conductive vias 5 formed by forming a plurality of via holes (also referred to as through holes) in two rows through the dielectric substrate 7 having the conductive layers 8 formed on two respective opposing surfaces and disposing a conductive member inside each of the via holes so that the conductive vias 5 become conductive with the upper and lower conductive layers 8. These conductive vias 5 can be relatively easily manufactured by a semiconductor process technology. The waveguide structure 6 is formed by the two rows of the conductive via groups 9 and 10, the dielectric substrate 7 therebetween, and the two opposing conductive layers 8. Since the waveguide structure 6 can be formed inside the dielectric substrate 7 as illustrated in FIG. 5B, the waveguide structure 6 can be reduced in size and thickness and can be easily manufactured, as compared with the waveguide 4 having a structure such as the one illustrated in FIG. 5A.

Figure 5C:
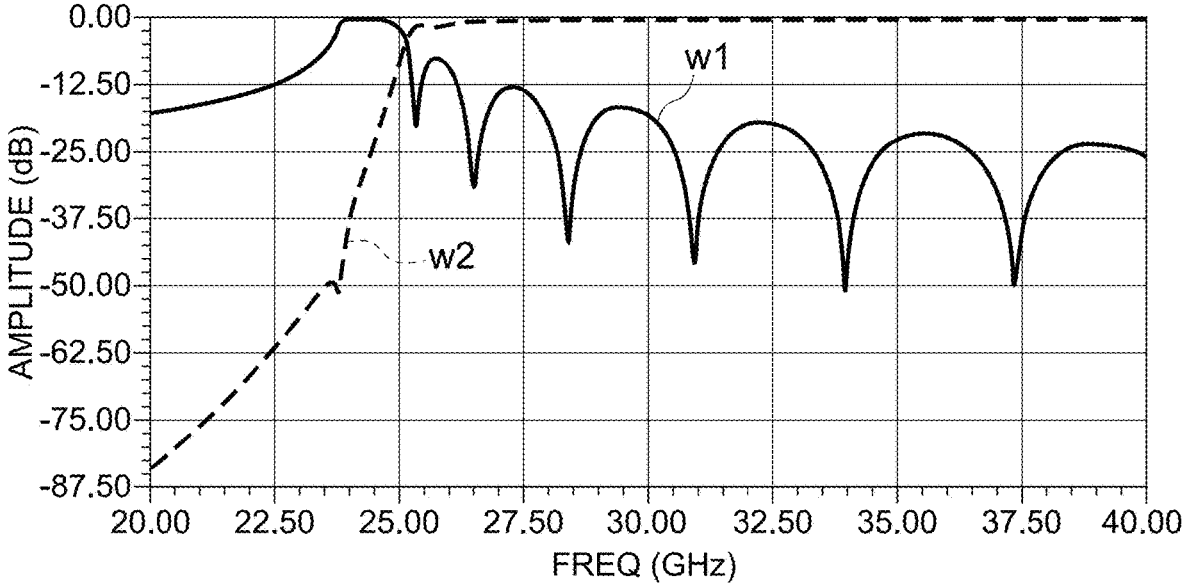
FIG. 5C is a diagram illustrating frequency characteristics of the substrate integrated waveguide structure of FIG. 5B.

FIG. 5C is a diagram illustrating frequency characteristics of the waveguide structure 6 of FIG. 5B. In FIG. 5C, the horizontal axis represents frequency, and the vertical axis represents amplitude [dB]. In FIG. 5C, the waveform w1 indicates frequency characteristics of an S parameter S11, and the waveform w2 indicates frequency characteristics of an S parameter S21. S11 indicates reflection characteristics on the input side, and S21 indicates transmission characteristics from the input side. As illustrated in FIG. 5C, the waveguide structure 6 of FIG. 5B does not have a function of reflecting a signal in a specific frequency band to the input side. In the filter 1 according to the present embodiment, the band rejection filter 1 that cuts off a signal in a specific frequency band is formed by adding a reflective resonator 3 to the waveguide structure 6 formed in the dielectric substrate 7 by the plurality of conductive vias 5. Hereinafter, representative specific examples of the filter according to the present embodiment will be described in order.

(First Example of Filter)

Figure 6:
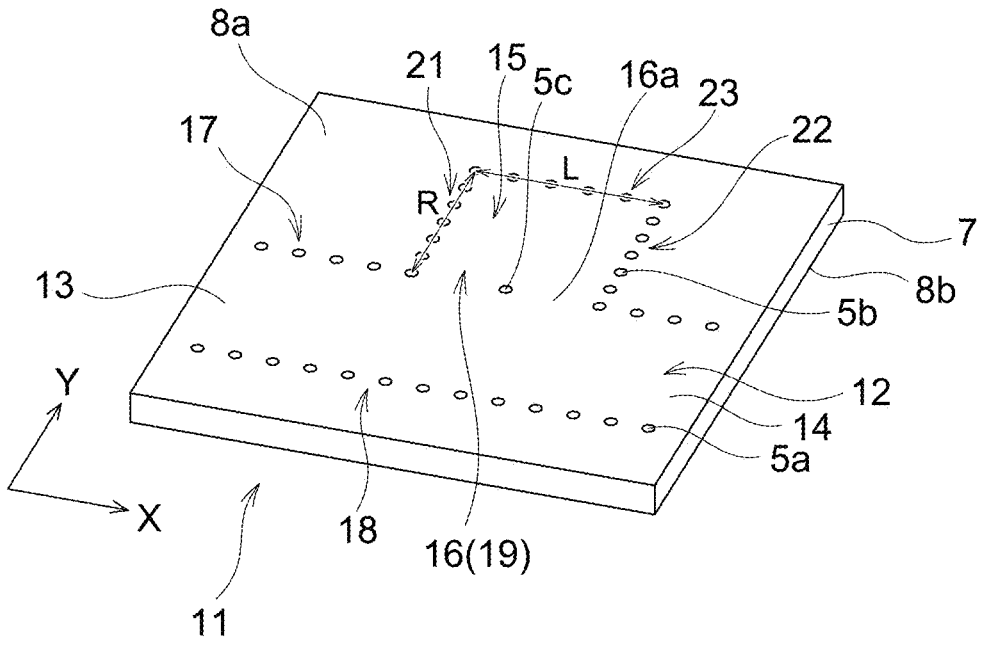
FIG. 6 is a perspective view of a filter of a first example.

FIG. 6 is a perspective view of a filter 11 of a first example. The filter 11 of FIG. 6 includes a dielectric substrate 7, a first conductive layer 8*a* and a second conductive layer 8*b*, a waveguide 12, an input port 13, an output port 14, a reflective resonator 15, and a coupling portion 16.

The first conductive layer 8*a* and the second conductive layer 8*b* are disposed on two opposing surfaces of the dielectric substrate 7, respectively. The waveguide 12 is disposed in a part of the dielectric substrate 7 and propagates a radio-frequency signal. The waveguide 12 is the waveguide structure 6 described above, and includes a first conductive via group 17 and a second conductive via group 18 including a plurality of first conductive vias 5*a* arranged periodically. Each of the first conductive via group 17 and the second conductive via group 18 acts as a metal wall and operates in a similar manner to the dielectric loaded waveguide 4. Therefore, the first conductive layer 8*a*, the dielectric substrate 7, and the second conductive layer 8*b* between the first conductive via group 17 and the second conductive via group 18 become the waveguide 12 of the waveguide structure 6. The waveguide 12 can propagate a radio-frequency signal in a first direction X by a region between the first conductive via group 17 and the second conductive via group 18.

As a material of the dielectric substrate 7, a ceramic material such as sapphire or alumina, a fluororesin material such as PTFE, quartz, glass cloth, or the like can be used in a case where wireless communication in a millimeter wave band is performed. As a material of the first conductive layer 8*a* and the second conductive layer 8*b*, a metal having small loss of a radio-frequency signal, such as copper, gold, or aluminum, may be used. The first conductive vias 5*a* may be metal plating of copper or gold formed on inner walls of via holes. As a specific example, the first conductive layer 8*a*, the second conductive layer 8*b*, and the first conductive vias 5*a* may be made of copper by using the dielectric substrate 7 made of alumina having a thickness of 0.5 mm.

The intervals between the first conductive vias 5*a* constituting the first conductive via group 17 and the second conductive via group 18 are not necessarily the same, but need to be sufficiently smaller than the wavelength of the radio-frequency signal propagating through the waveguide 12. More specifically, in a case where the intervals between the first conductive vias 5*a* are set equal to or less than $\lambda g/4$ to $\lambda g/8$ with respect to a guide wavelength $\lambda g$ of the radio-frequency signal propagating through the waveguide 12, it is possible to suppress leakage of the signal from the first conductive via group 17 and the second conductive via group 18. As a specific example, assuming that a signal in a 20 GHz to 30 GHz band is propagated, the intervals between the first conductive vias 5*a* in the first conductive via group 17 and the second conductive via group 18 are set to 0.5 mm.

The waveguide 12 extends in the first direction X and propagates a radio-frequency signal in the first direction X. Each of the plurality of first conductive vias 5*a* passes through the dielectric substrate 7 from the first conductive layer 8*a* to the second conductive layer 8*b*, and the first conductive vias 5*a* are conducive with the first conductive layer 8*a* and the second conductive layer 8*b*. The first conductive via group 17 and the second conductive via group 18 are arranged apart from each other in a second direction Y intersecting the first direction X. The second direction Y may be, for example, a direction orthogonal to the first direction X. The input port 13 is provided at one end of the waveguide 12 in the first direction X, and the output port 14 is provided at the other end. A radio-frequency signal is input to the waveguide 12 via the input port 13. The radio-frequency signal that has propagated through the waveguide 12 is output from the output port 14.

The reflective resonator 15 is disposed in a direction (for example, the second direction Y) intersecting the first direction X that is a signal propagation direction of the radio-frequency signal in the waveguide 12. The reflective resonator 15 reflects a signal in a predetermined frequency band in the radio-frequency signal propagating through the waveguide 12 toward the input port 13. The predetermined frequency band is, for example, a resonance frequency of the reflective resonator 15. As described above, by coupling the reflective resonator 15 to the waveguide 12, it is possible to prevent a signal of a resonance frequency component of the reflective resonator 15 in the radio-frequency signal propagating through the waveguide 12 from being propagated, and therefore the filter 11 can function as a band rejection filter.

The reflective resonator 15 is disposed around a defective part 19 that is provided in a part of the first conductive via group 17 and where the first conductive vias 5*a* are missing. The reflective resonator 15 includes third conductive via groups 21 to 23 and a fourth conductive via 5*c*. The third conductive via groups 21 to 23 pass through the dielectric substrate 7 from the first conductive layer 8*a* to the second conductive layer 8*b*, and are arranged apart from one another along a periphery of a region in contact with the defective part 19 that is provided in a part of the first conductive via group 17 and where the first conductive via group 17 is missing. The fourth conductive via passes through the dielectric substrate 7 from the first conductive layer 8*a* to the second conductive layer 8*b*, and has one or more fourth conductive vias 5*c* disposed in the defective part 19. Each of third conductive vias 5*b* constituting the third conductive via groups 21 to 23 and the fourth conductive via 5*c* may have a same diameter size as the first conductive vias 5*a* or may have a different diameter size from the first conductive vias 5*a*. The reflective resonator 15 is coupled to the waveguide 12 in an electromagnetic field and reflects a signal in a predetermined frequency band in the radio-frequency signal propagating through the waveguide 12.

A coupling portion 16 is provided in the defective part 19. The coupling portion 16 couples the waveguide 12 and the reflective resonator 15 in an electromagnetic field via a coupling hole 16*a* between the fourth conductive via 5*c* and two first conductive vias 5*a* of the first conductive via groups 17 at both ends of the defective part 19. The coupling portion 16 is disposed in the defective part 19 and has the fourth conductive via 5*c* that passes through the dielectric substrate 7 from the first conductive layer 8*a* to the second conductive layer 8*b*. The fourth conductive via 5*c* may have a same diameter size as the first conductive vias 5*a* or the third conductive vias 5*b* or may have a different diameter size from the first conductive vias 5*a* or the third conductive vias 5*b*. In the present specification, the first conductive vias 5*a*, the third conductive vias 5*b*, and the fourth conductive via 5*c* may be referred to as metal posts as necessary.

A length of the defective part 19 in the first direction X is set wider than an interval of two adjacent first conductive vias 5*a* of the first conductive via group 17 in a portion other than the defective part 19. The reflective resonator 15 includes the plurality of third conductive vias 5*b* arranged from the two first conductive vias 5*a* at both ends of the defective part 19 so as to be spaced apart from each other in a direction (for example, the second direction Y) intersecting the first direction X.

As a more specific example, the third conductive via groups 21 to 23 in the reflective resonator 15 include, for example, a fifth conductive via group 21 and a sixth conductive via group 22 having a plurality of third conductive vias 5*b* arranged from the two first conductive vias 5*a* at both ends of the defective part 19 so as to be spaced apart from each other in the second direction Y, as illustrated in FIG. 6. Furthermore, as a specific example, the third conductive via groups 21 to 23 include a seventh conductive via group 23 having a plurality of third conductive vias 5*b* arranged apart between ends of the fifth conductive via group 21 and the sixth conductive via group 22.

The reflective resonator 15 is coupled to the waveguide 12 in an electromagnetic field to perform an operation of reflecting a signal of a resonance frequency of the reflective resonator 15. Therefore, two parameters: the resonance frequency and a coupling amount with the waveguide 12 are important in the reflective resonator 15. The resonance frequency of the reflective resonator 15 is determined by a size of the reflective resonator 15. The reflective resonator 15 of FIG. 6 has a structure in which a dielectric is surrounded by a metal wall including the fifth conductive via group 21, the sixth conductive via group 22, and the seventh conductive via group 23, and can realize a resonator 3 resonating at a specific frequency.

FIG. 6 illustrates an example of the reflective resonator 15 having a rectangular planar shape, but may have any shape such as a circular shape. The reflective resonator 15 resonates in various resonance modes other than a resonance mode to be used. Therefore, by changing the shape of the reflective resonator 15, it is possible to select a resonance mode of resonating at a frequency to be cut off. In the example of FIG. 6, the waveguide 12 has a rectangular parallelepiped shape having a length L of 2.5 mm in the first direction X and a width R of 2.55 mm in the second direction Y.

In the filter 11 of FIG. 6, the waveguide 12 and the reflective resonator 15 are coupled by the defective part 19 in which the plurality of first conductive vias 5*a* constituting the first conductive via group 17 are missing. The coupling portion 16 provided in the defective part 19 has the coupling hole 16*a* through which an electromagnetic field passes. As will be described later, reflection characteristics on a low-frequency side and reflection characteristics on a radio-frequency side with respect to the resonance frequency are not symmetrical unless a conductive via is provided in the coupling hole 16*a*, and therefore, in the filter 11 of FIG. 6, the fourth conductive via 5*c* is disposed near a center position of the coupling hole 16*a*. As described above, the fourth conductive via 5*c* may have the same diameter size as the first conductive vias 5*a* or the third conductive vias 5*b* or may have a different diameter size from the first conductive vias 5*a* or the third conductive vias 5*b*. The fourth conductive via 5*c* is disposed apart, by 4L/10 or more, from the fifth conductive via group 21 located on one end side of the defective part 19 and apart, by 4L/10 or more, from the sixth conductive via group 22 located on the other end side of the defective part 19, where L is a length of the defective part 19 in the first direction X (a length of the seventh conductive via group 23).

Figure 7:
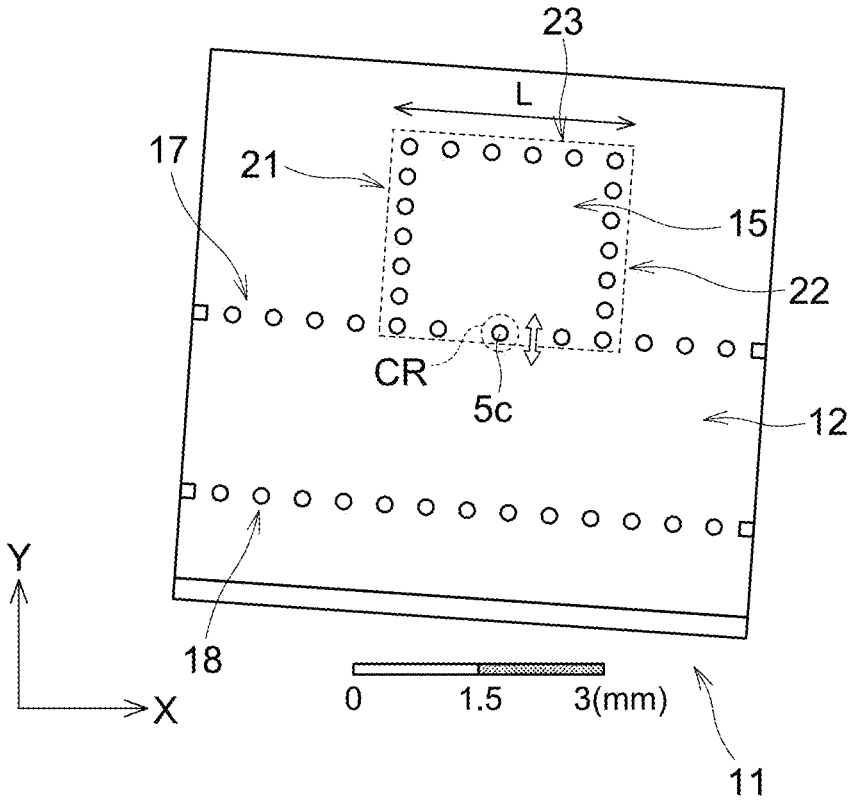
FIG. 7 is a view illustrating an example of adjustment of a position of a third conductive via.

The fourth conductive via 5*c* provided in the defective part 19 may be shifted, for example, in the second direction Y as indicated by the arrow line in FIG. 7. FIG. 7 illustrates an example in which the position of the fourth conductive via 5*c* is adjusted within a predetermined range (range of the circle CR in FIG. 7) around the center position of the defective part 19 in the first direction X. The predetermined range may be not only in the second direction Y but also in the first direction X. The predetermined range may be a range of ±L/5 or less around the center position of the defective part 19.

The length of the defective part 19 in the first direction X may be determined by a correlation between the frequency and signal power of the radio-frequency signal propagating through the waveguide 12 and the frequency and signal power of the signal reflected by the reflective resonator 15.

Figure 8A:
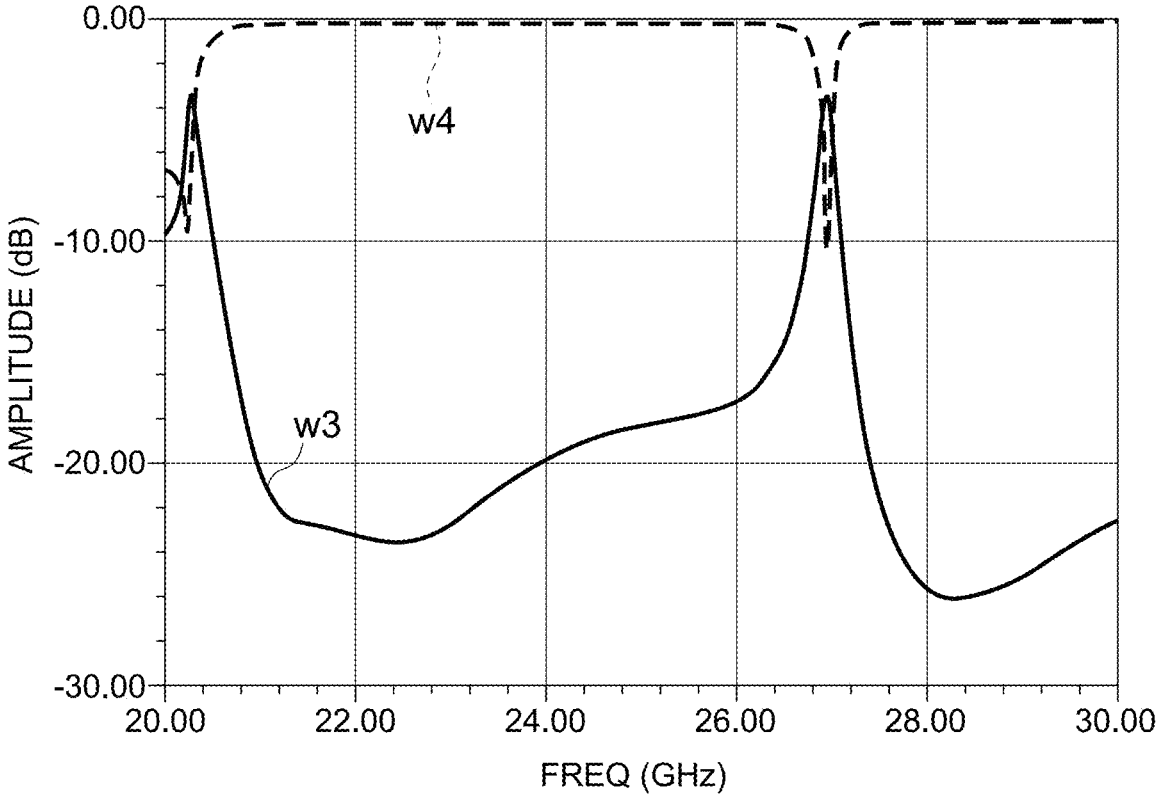
FIG. 8A is a frequency characteristic diagram in a case where a third conductive via is disposed at a center position of a defective part in a first direction.
Figure 8B:
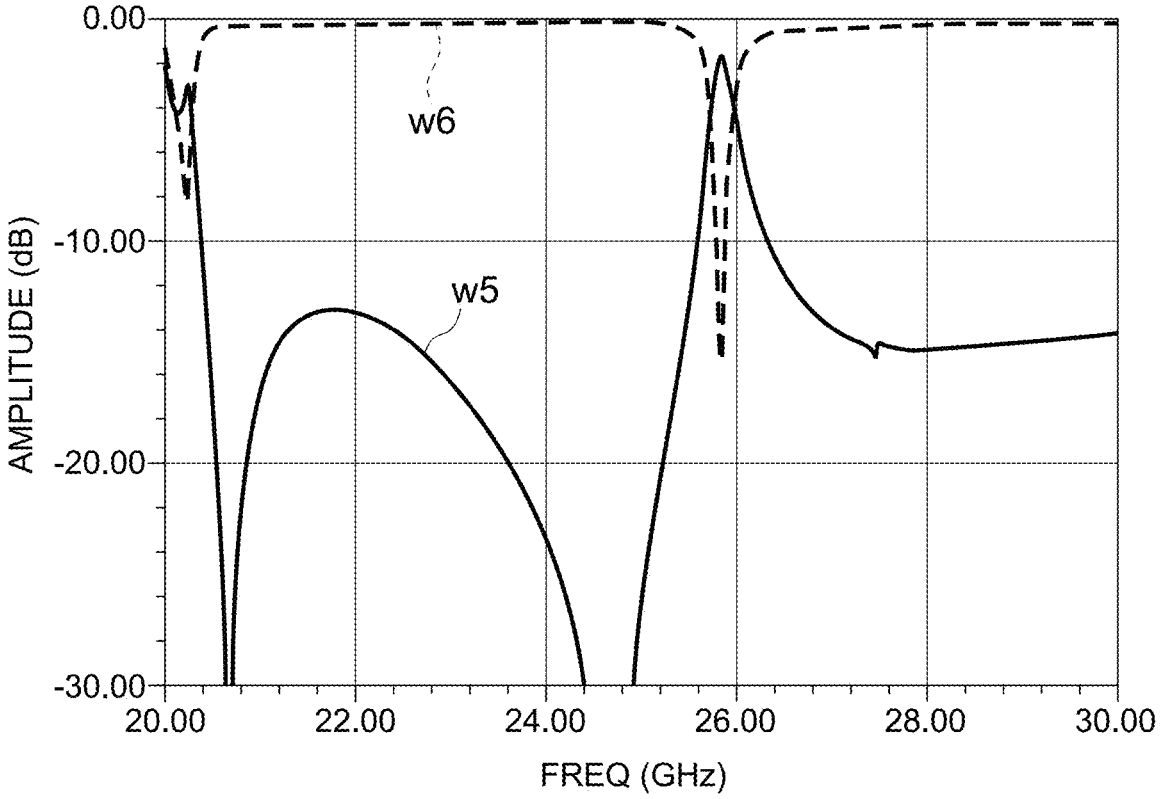
FIG. 8B is a frequency characteristic diagram in a case where the third conductive via is shifted from the center position toward a reflective resonator.
Figure 8C:
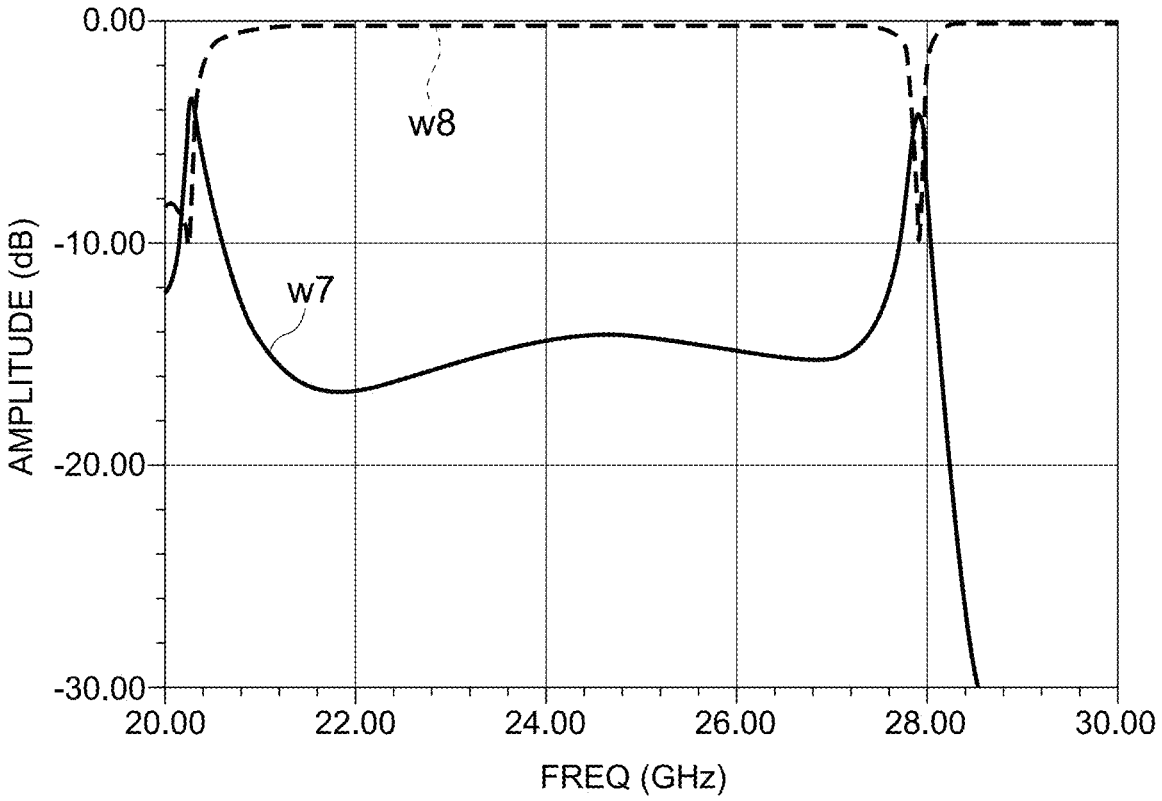
FIG. 8C is a frequency characteristic diagram in a case where the third conductive via is shifted from the center position toward a waveguide.

FIGS. 8A, 8B, and 8C are diagrams illustrating frequency characteristics of the filter 11 obtained in a case where the position of the fourth conductive via 5*c* is adjusted within the predetermined range of FIG. 7. FIG. 8A illustrates frequency characteristics obtained in a case where the fourth conductive via 5*c* is disposed at the center position of the defective part 19 in the first direction X, FIG. 8B illustrates frequency characteristics obtained in a case where the fourth conductive via 5*c* is shifted from the center position toward the reflective resonator 15, and FIG. 8C illustrates frequency characteristics obtained in a case where the fourth conductive via 5*c* is shifted from the center position toward the waveguide 12. In FIGS. 8A to 8C, the horizontal axis represents the frequency [GHz], and the vertical axis represents the amplitude [dB].

The waveforms w3, w5, and w7 in FIGS. 8A to 8C are S parameters S11 and indicate reflection characteristics. The waveforms w4, w6, and w8 are parameters S21 and indicate transmission characteristics. In a case where the fourth conductive via 5*c* is disposed at the center position of the defective part 19, reflection characteristics on a low band side and reflection characteristics on a high band side of the resonance frequency are substantially symmetrical as illustrated in FIG. 8A. Meanwhile, in a case where the fourth conductive via 5*c* is shifted from the center position of the defective part 19 toward the reflective resonator 15, the reflection characteristics on the low band side of the resonance frequency greatly drop, and the reflection characteristics on the low band side and the reflection characteristics on the high band side of the resonance frequency become asymmetric, as illustrated in FIG. 8B. In a case where the fourth conductive via 5*c* is shifted from the center position of the defective part 19 toward the waveguide 12, the reflection characteristics on the high band side of the resonance frequency greatly drop, and the reflection characteristics on the low band side and the reflection characteristics on the high band side of the resonance frequency become asymmetric, as illustrated in FIG. 8C.

As can be seen from FIGS. 8A to 8C, the asymmetry of the reflection characteristics of the filter 11 can be controlled by adjusting the position of the fourth conductive via 5*c* provided near the center position in the defective part 19 within a predetermined range. Therefore, by finely adjusting the position of the fourth conductive via 5*c*, the symmetry between the low band side and the high band side of the resonance frequency can be improved, and a band rejection filter having excellent frequency characteristics can be obtained.

Figure 9:
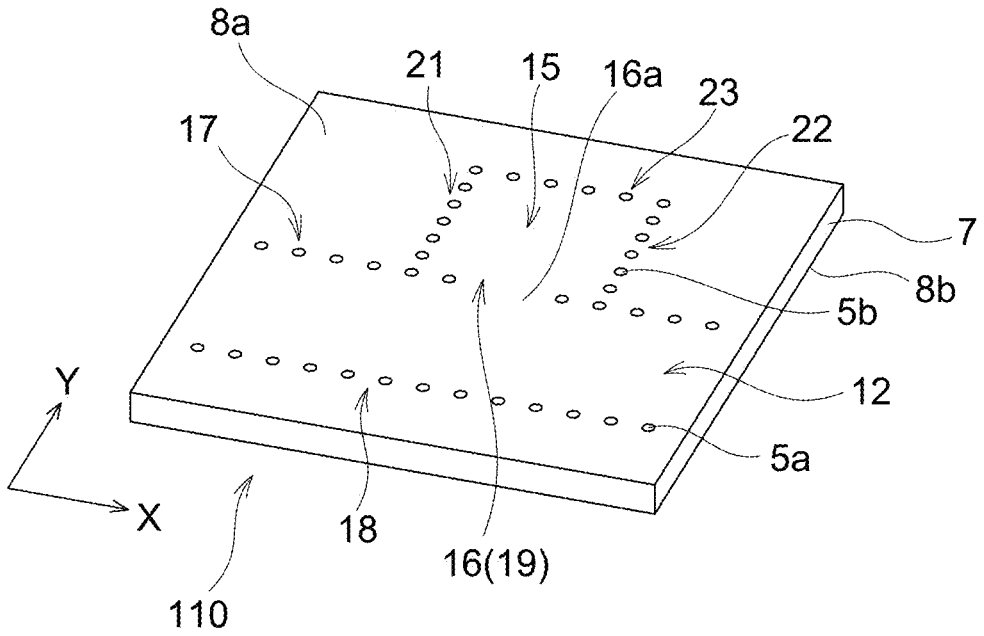
FIG. 9 is a perspective view of a filter according to a comparative example.

FIG. 9 is a perspective view of a filter 110 according to a comparative example. The filter 110 of FIG. 9 includes the waveguide 12 of the waveguide structure 6 including the first conductive via group 17 and the second conductive via group 18, and the reflective resonator 15 including the fifth conductive via group 21 to the seventh conductive via group 23 as in FIG. 6, but is different from the filter 11 of FIG. 6 in that the fourth conductive via 5*c* illustrated in FIG. 6 is not provided in the defective part 19 provided in a part of the first conductive via group 17.

Figure 10:
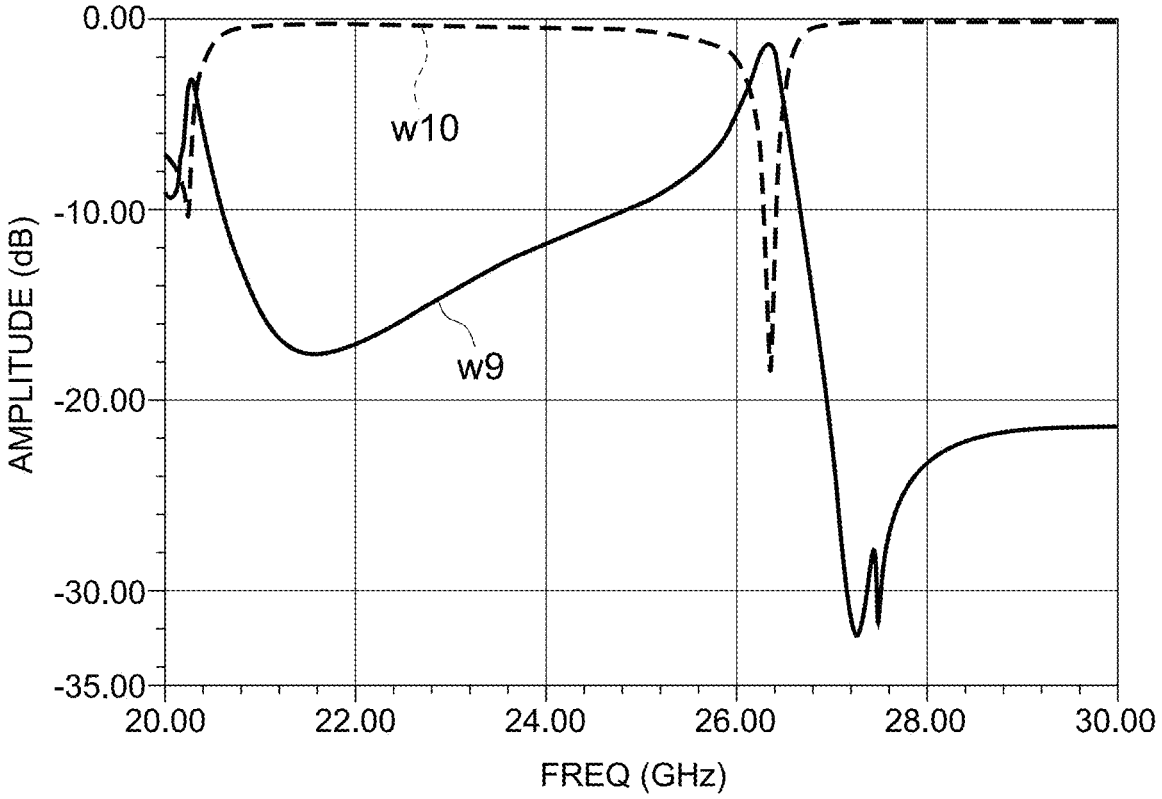
FIG. 10 is a frequency characteristic diagram of the filter of FIG. 9.

FIG. 10 is a frequency characteristic diagram of the filter 11 of FIG. 9. In FIG. 10, the waveform w9 is an S parameter S11, and the waveform w10 is an S parameter S21. As can be seen from FIG. 10, in a case where the fourth conductive via 5*c* is not provided in the defective part 19, a change in reflection characteristic is gentle on the low band side of the resonance frequency, whereas a change in reflection characteristic is steep on the high band side of the resonance frequency, and the reflection characteristics on the low band side and the reflection characteristics on the high band side of the resonance frequency become asymmetric. Therefore, according to the structure of FIG. 9, there is a possibility that a band rejection filter having excellent band rejection characteristics for cutting off only a signal in a specific frequency band cannot be obtained.

Meanwhile, in the filter 11 of FIG. 6, the fourth conductive via 5*c* is disposed close to the center position in the defective part 19, and the position of the fourth conductive via 5*c* is adjusted within a predetermined range, and therefore a band stop filter which is excellent in band rejection characteristics and can be reduced in size and thickness can be manufactured.

Figure 11A:
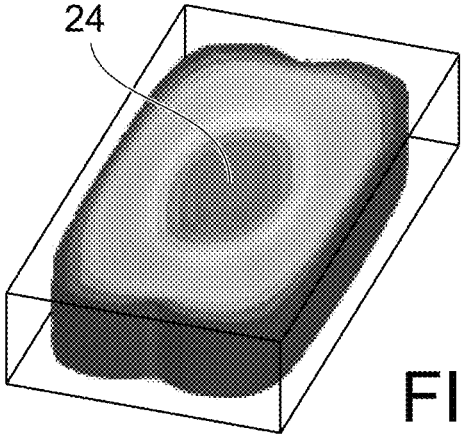
FIG. 11A is a diagram schematically illustrating an electric field distribution in a case where there is one peak of an electric field in a signal propagation direction.
Figure 11B:
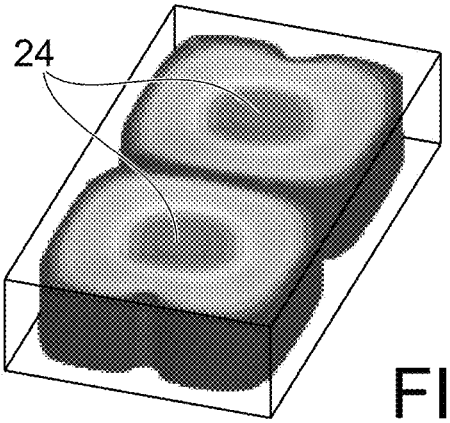
FIG. 11B is a diagram schematically illustrating an electric field distribution in a case where there are two peaks of an electric field in the signal propagation direction.
Figure 11C:
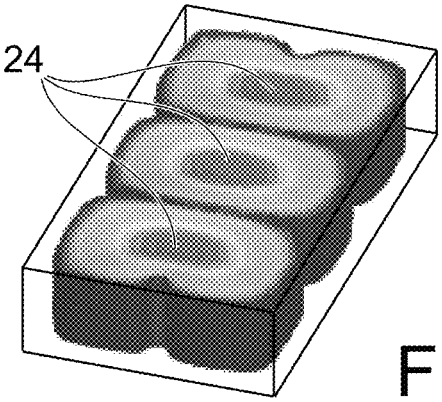
FIG. 11C is a diagram schematically illustrating an electric field distribution in a case where there are three peaks of an electric field in the signal propagation direction.

Although one fourth conductive via 5*c* is disposed in the defective part 19 of the first conductive via group 17 in the filter 11 of FIG. 6, asymmetry occurring in a case where the reflective resonator 15 is caused to resonate in a higher-order mode can be improved by increasing the number of fourth conductive vias 5*c* in the defective part 19. FIG. 11A is a diagram schematically illustrating an electric field distribution obtained in a case where there is one peak 24 of the electric field in the signal propagation direction in the reflective resonator 15. In this case, the fourth conductive via 5*c* need just be disposed near the center of the defective part 19 as illustrated in FIG. 6. FIG. 11B is a diagram schematically illustrating an electric field distribution obtained in a case where there are two peaks 24 of the electric field in the signal propagation direction in the reflective resonator 15. In this case, two fourth conductive vias 5*c* need just be disposed in the defective part 19. FIG. 11C is a diagram schematically illustrating an electric field distribution obtained in a case where there are three peaks 24 of the electric field in the signal propagation direction in the reflective resonator 15. In this case, three fourth conductive vias 5*c* need just be disposed in the defective part 19.

As described above, asymmetry occurring in a case where the reflective resonator 15 is caused to resonate in a higher-order mode can be improved by providing two or more fourth conductive vias 5*c* in the defective part 19. By causing the reflective resonator 15 to resonate in a higher-order mode, the cutoff frequency of the band rejection filter can be switched. This is generalized. The reflective resonator 3 in the filter 11 of FIG. 6 resonates in a resonance mode having n (n is an integer of 1 or more) electric field peaks 24 in the signal propagation direction. In this case, the coupling portion 16 has n fourth conductive vias 5*c* in the defective part 19. By adjusting the positions of the n fourth conductive vias 5*c*, asymmetry occurring in a case where the reflective resonator 15 is caused to resonate in a higher-order mode can be improved, a filter using a higher-order mode can be configured, and a signal in a frequency band including a resonance frequency can be cut off. The n fourth conductive vias 5*c* are disposed within a range of $\pm L/(10\times n)$ or less in the second direction Y from the center position of the defective part 19.

(Second Example of Filter 11)

Figure 12:
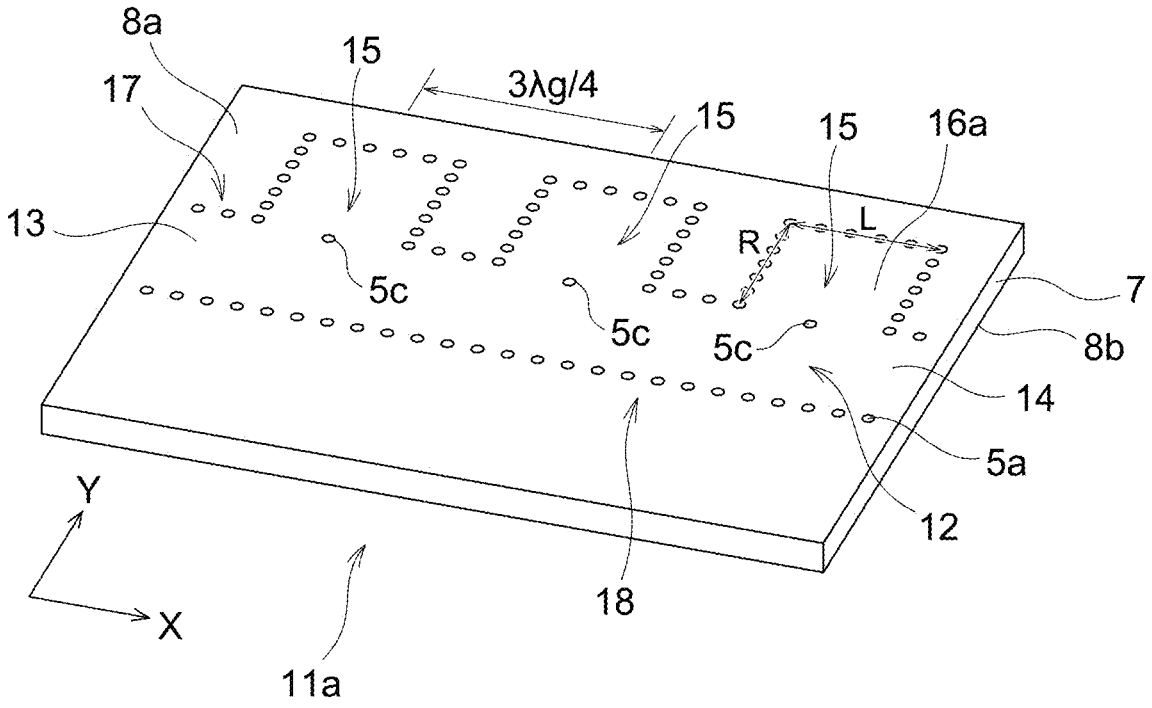
FIG. 12 is a perspective view of a filter of a second example.

FIG. 12 is a perspective view of a filter 11*a* of a second example. The filter 11*a* in FIG. 12 includes a plurality of reflective resonators 15 arranged on one side in the signal propagation direction of the waveguide 12. Although three reflective resonators 15 are disposed in the signal propagation direction of the waveguide 12 in FIG. 12, the number of reflective resonators 15 is not limited in particular. Each of the reflective resonators 15 in FIG. 12 is arranged in the second direction Y from the defective part 19 provided in a part of the first conductive via group 17 in a similar manner to the reflective resonator 15 in FIG. 6. The first conductive via group 17 is provided with the same number of defective parts 19 as the number of reflective resonators 15. Each reflective resonator 15 is coupled to the waveguide 12 in an electromagnetic field via the coupling hole 16*a* of the coupling portion 16 provided in the defective part 19. The fourth conductive via 5*c* is disposed near the center position of the defective part 19. By adjusting the positions of the fourth conductive vias 5*c*, symmetry of the frequency characteristics on the low band side and the frequency characteristics on the high band side of the resonance frequency can be improved, and curves of pass characteristics and reflection characteristics can be adjusted.

The plurality of reflective resonators 15 in the filter 11*a* are the same in terms of a length R of the fifth conductive via group 21 and the sixth conductive via group 22 and a length L of the seventh conductive via group 23 of each reflective resonator 15 so as to have the same resonance frequency.

The plurality of reflective resonators 15 in FIG. 12 is arranged in the first direction X (signal propagation direction) at intervals of, for example, $3\lambda g/4$, where $\lambda g$ is a guide wavelength corresponding to a center frequency of band rejection. As a result, the plurality of reflective resonators 15 can be arranged in a narrow range, and therefore the size of the filter 11*a* can be reduced. Note that the interval between two reflective resonators 15 adjacent in the first direction X permits a certain degree of error, and it is desirable to arrange the reflective resonators 15, for example, within a range of $3\lambda g/4\pm 20\%$.

Figure 13:
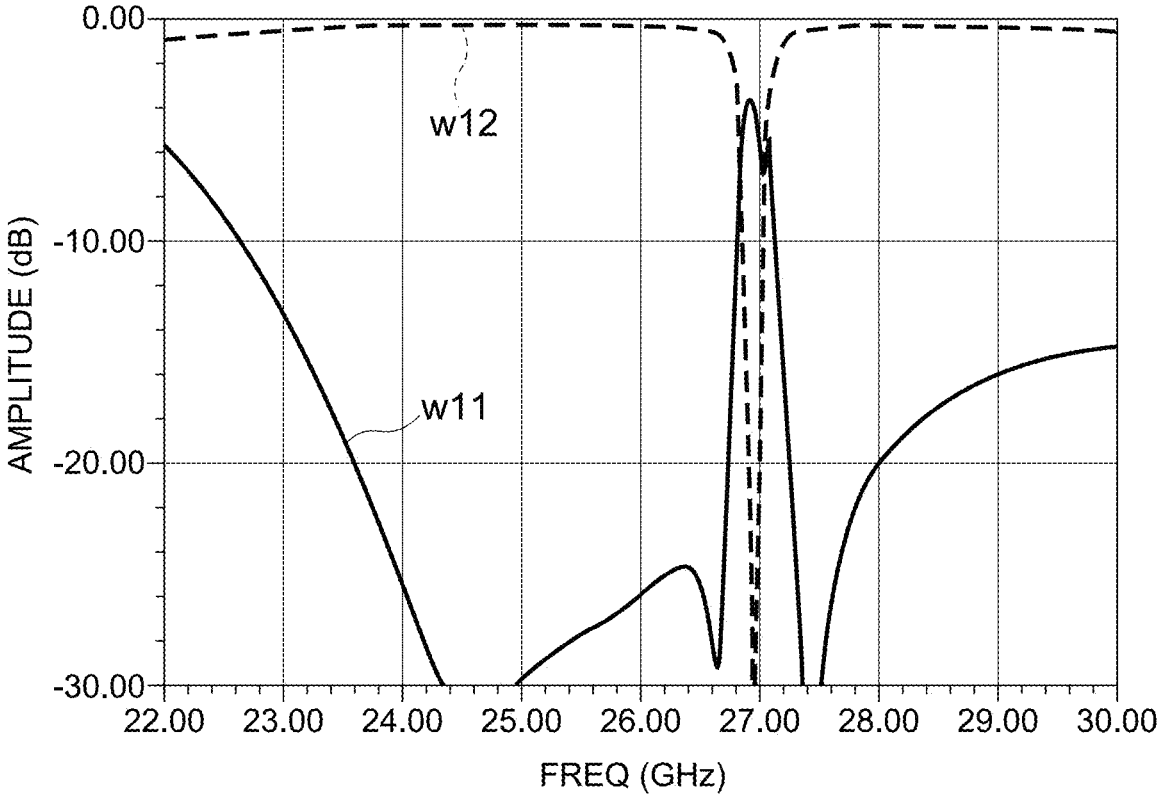
FIG. 13 is a diagram illustrating frequency characteristics of the filter of FIG. 12.

FIG. 13 is a diagram illustrating frequency characteristics of the filter 11*a* of FIG. 12. In FIG. 13, the waveform w11 indicates frequency characteristics of an S parameter S11, and the waveform w12 indicates frequency characteristics of an S parameter S21. By providing the three reflective resonators 15 in the filter 11*a* as illustrated in FIG. 12, symmetry between a low band side and a high band side of a rejection band of 27 GHz is improved. In a case where it is desired to further improve attenuation characteristics on the high band side, it is possible to make the attenuation characteristics on the high band side steeper by shifting the positions of the fourth conductive vias 5*c* toward the reflective resonators 15. In this case, attenuation characteristics on the low band side of the resonance frequency deteriorate, and therefore the frequency characteristics of the filter 11*a* can be improved by positively utilizing the asymmetry of the filter 11*a* by finely adjusting the positions of the fourth conductive vias 5*c*.

(Third Example of Filter 11)

Figure 14:
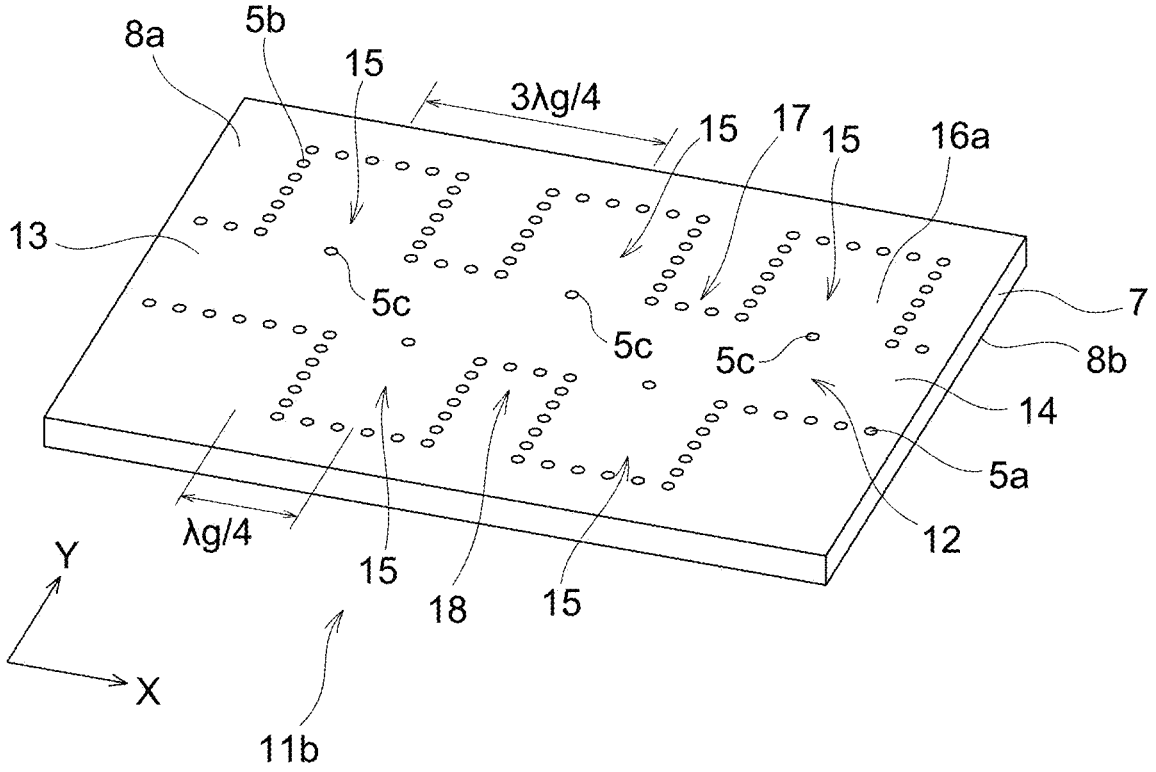
FIG. 14 is a perspective view of a filter of a third example.

FIG. 14 is a perspective view of a filter 11*b* of a third example. The filter 11*b* of FIG. 14 includes a plurality of reflective resonators 15 arranged on both sides of the waveguide 12 in the signal propagation direction. More specifically, in the filter 11*b* of FIG. 14, the plurality of reflective resonators 15 are arranged in the second direction Y from the plurality of defective parts 19 in the first conductive via group 17, and the plurality of reflective resonators 15 are arranged in the second direction Y from the plurality of defective parts 19 in the second conductive via group 18.

Also in the filter 11*b* of FIG. 14, the waveguide 12 is the waveguide structure 6 including the first conductive via group 17 and the second conductive via group 18 passing through the dielectric substrate 7. The plurality of reflective resonators 15 are coupled to the waveguide 12 in an electromagnetic field via coupling holes 16*a*. The fourth conductive via 5*c* is disposed near the center position of each of the coupling holes 16*a*. The plurality of reflective resonators 15 are alternately arranged on both sides of the waveguide 12 in the signal propagation direction. An interval between two reflective resonators 15 adjacent in the first direction X is $3\lambda g/4$ where $\lambda g$ is a guide wavelength of a signal propagating through the waveguide 12. Further, an interval between the reflective resonator 15 connected to the first conductive via group 17 and the reflective resonator 15 connected to the second conductive via group 18 is $\lambda g/4$. That is, the plurality of reflective resonators 15 are alternately arranged at an interval of $\lambda g/4$ on both sides of the waveguide 12 in the signal propagation direction. The interval $3\lambda g/4$ and the interval $\lambda g/4$ described above permit a certain degree of error, and two reflective resonators 15 adjacent in the first direction X are arranged within a range of ±20% from a reference interval $3\lambda g/4$. Furthermore, two reflective resonators 15 alternately arranged along the signal propagation direction of the waveguide 12 are arranged within a range of ±20% from a reference interval $\lambda g/4$.

Although three reflective resonators 15 are arranged on one side of the waveguide 12 in the signal direction and two reflective resonators 15 are arranged on the other side in FIG. 14, this is an example, and the number of reflective resonators 15 alternately arranged on both sides of the waveguide 12 in the signal direction is not limited in particular.

(Fourth Example of Filter 11)

Figure 15:
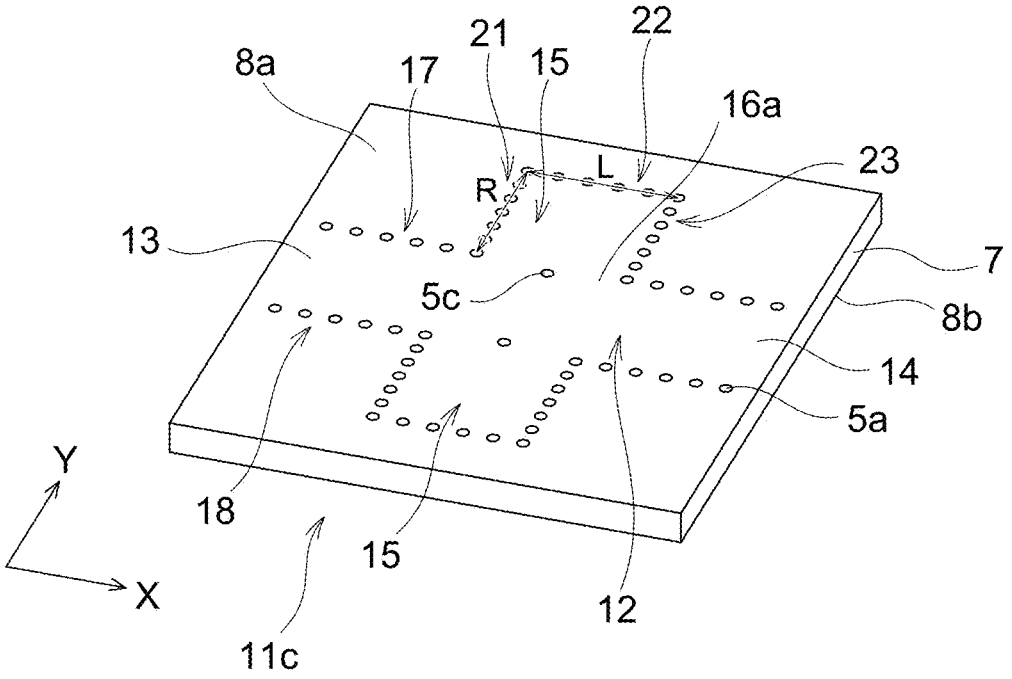
FIG. 15 is a perspective view of a filter of a fourth example.

FIG. 15 is a perspective view of a filter 11*c* of a fourth example. In the filter 11*c* of FIG. 15, a plurality of reflective resonators 15 are arranged to face each other on both sides of the waveguide 12 of the waveguide structure 6 in the signal propagation direction. The waveguide 12 includes the first conductive via group 17 and the second conductive via group 18, as in the filters 11*a*, 11*b*, and 11*c* of the first to third examples. Each of the reflective resonators 15 also includes the fifth conductive via group 21, the sixth conductive via group 22, and the seventh conductive via group 23, as in the filters 11*a*, 11*b*, and 11*c* of the first to third examples. The reflective resonators 15 have the same size.

Each of the reflective resonators 15 is coupled to the waveguide 12 in an electromagnetic field via a corresponding coupling hole 16*a*. The fourth conductive via 5*c* is disposed near the center of each coupling hole 16*a*. Frequency characteristics of the filter 11*c* in FIG. 15 can be adjusted by adjusting positions of the fourth conductive vias 5*c*.

The filter 11*c* of FIG. 15 is different from the filter 11*c* of FIG. 14 in that two reflective resonators 15 are arranged to face each other with the waveguide 12 interposed therebetween. As described above, the two reflective resonators 15 have the same size and shape and therefore have the same resonance frequency. By coupling these reflective resonators 15 with the waveguide 12, characteristics similar to those of a strongly coupled reflective resonator 15 can be obtained.

For example, a total external Q value of the two reflective resonators 15 is Qe1/2 where Qe1 is an external Q value of one reflective resonator 15. Therefore, the filter 11*c* of FIG. 15 can be used, for example, in a case where an external Q value necessary for configuring a wideband filter 11*c* cannot be obtained by a structure in which a single reflective resonator 15 is provided.

Although a single reflective resonator 15 is disposed on each side of the waveguide 12 in the signal propagation direction in the filter 11*c* of FIG. 15, a plurality of reflective resonators 15 may be disposed on each side of the waveguide 12 in the signal propagation direction so that corresponding reflective resonators 15 on both sides face each other.

(Fifth Example of Filter 11)

Figure 16:
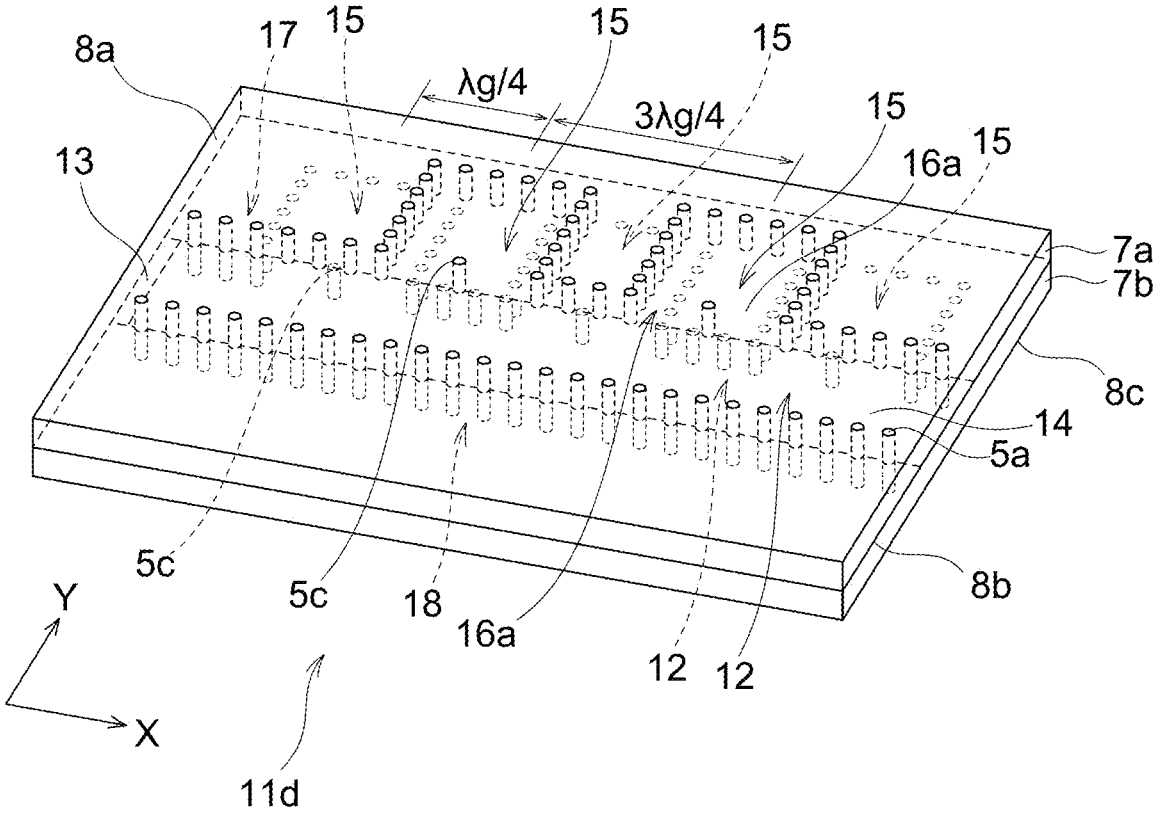
FIG. 16 is a perspective view of a filter of a fifth example.

FIG. 16 is a perspective view of a filter 11*d* of a fifth example. The filter 11*d* of FIG. 16 includes a plurality of stacked dielectric substrates 7*a* and 7*b*. The first conductive layer 8*a* and the second conductive layer 8*b* are disposed on two opposing surfaces of each of the plurality of dielectric substrates 7*a* and 7*b*. The reflective resonators 15, the coupling portions 16, the first conductive via group 17, and the second conductive via group 18 are disposed on each of the plurality of dielectric substrates 7*a* and 7*b*. The waveguide structure 6 is constituted by the dielectric substrates 7, the first conductive layer 8*a* and the second conductive layer 8*b* on both sides of each of the dielectric substrates 7, and the first conductive via group 17 and the second conductive via group 18 passing through each of the dielectric substrates 7.

As described above, in the filter 11*d* of FIG. 16, the waveguide 12 of the waveguide structure 6 is disposed on each of the plurality of stacked dielectric substrates 7*a* and 7*b*, and each waveguide 12 includes the input port 13 to which a radio-frequency signal is input and the output port 14 to which a radio-frequency signal is output.

The first conductive via groups 17 and the second conductive via groups 18 passing through the dielectric substrates 7 are arranged so as to overlap in the stacking direction when the filter 11*d* of FIG. 16 is viewed in plan view from a substrate surface. Therefore, the first conductive via groups 17 and the second conductive via groups 18 of the dielectric substrates 7*a* and 7*b* can be collectively formed by stacking the plurality of dielectric substrates 7*a* and 7*b*, forming via holes passing through the dielectric substrates 7, and covering inner wall surfaces of the via holes with a conductive material. As a result, the waveguides 12 provided on the dielectric substrates 7*a* and 7*b* can be arranged at the same position overlapping in the stacking direction when viewed in plan from a direction normal to the substrate surface.

The reflective resonators 15 are connected to each waveguide 12 via the coupling portions 16. Each reflective resonator 15 is coupled to the waveguide 12 in an electromagnetic field via the coupling hole 16*a* of the coupling portion 16. The fourth conductive via 5*c* is disposed in each coupling portion 16. Frequency characteristics of the filter 11*d* of FIG. 16 can be adjusted by adjusting positions of the fourth conductive vias 5*c*.

The reflective resonators 15 of the dielectric substrates 7 are arranged so as to be shifted in the signal propagation direction of the waveguide 12 in each of the dielectric substrates 7*a* and 7*b*. Specifically, the reflective resonators 15 are alternately arranged on the dielectric substrates 7 at an interval of $\lambda g/4$ where $\lambda g$ is a guide wavelength of a radio-frequency signal propagating through the waveguide 12. The reflective resonators 15 in the same dielectric substrate 7 are arranged at an interval of $3\lambda g/4$. These intervals permit an error within ±20%.

Each of the reflective resonators 15 includes the fifth conductive via group 21, the sixth conductive via group 22, and the seventh conductive via group 23, as in the reflective resonator 15 in the filters 11, 11*a*, 11*b*, 11*c*, and 11*d* of the first to fourth examples.

Although the plurality of reflective resonators 15 are arranged on one side, in the signal propagation direction, of the waveguide 12 arranged on each of the dielectric substrates 7*a* and 7*b* in FIG. 16, a side on which the reflective resonators 15 are arranged in the dielectric substrate 7*a* and a side on which the reflective resonators 15 are arranged in the dielectric substrate 7*b* may be opposite to each other.

In the filter 11*d* of FIG. 16, the plurality of dielectric substrates 7*a* and 7*b* are stacked, and the waveguide 12 of the waveguide structure 6 and the plurality of reflective resonators 15 are arranged in each of the dielectric substrates 7*a* and 7*b*, and therefore, a size of the entire filter 11*d* can be suppressed, and a small multi-stage band rejection filter can be formed.

Although an example in which the two dielectric substrates 7*a* and 7*b* are stacked is illustrated in FIG. 16, the number of stacked dielectric substrates 7 is not limited in particular. Since the waveguide 12 and the reflective resonators 15 can be formed on each dielectric substrate 7, the number of reflective resonators 15 to be formed on one dielectric substrate 7 can be reduced. Therefore, as the number of stacked dielectric substrates 7 increases, the area of the entire filter 11*d* can be further reduced.

(Configuration of Wireless Communication System)

The filters 11, 11*a*, 11*b*, 11*c*, and 11*d* of the first to fifth examples described above can be used in a wireless transmitter or a wireless communication system. The wireless communication system may have only a transmission function or may have a transmission function and a reception function. A wireless communication system having only a transmission function may be referred to as a wireless transmitter. Although an example of an internal configuration of a wireless communication system having a transmission function and a reception function will be described below, a wireless communication system having only a transmission function can also be configured.

Figure 17A:
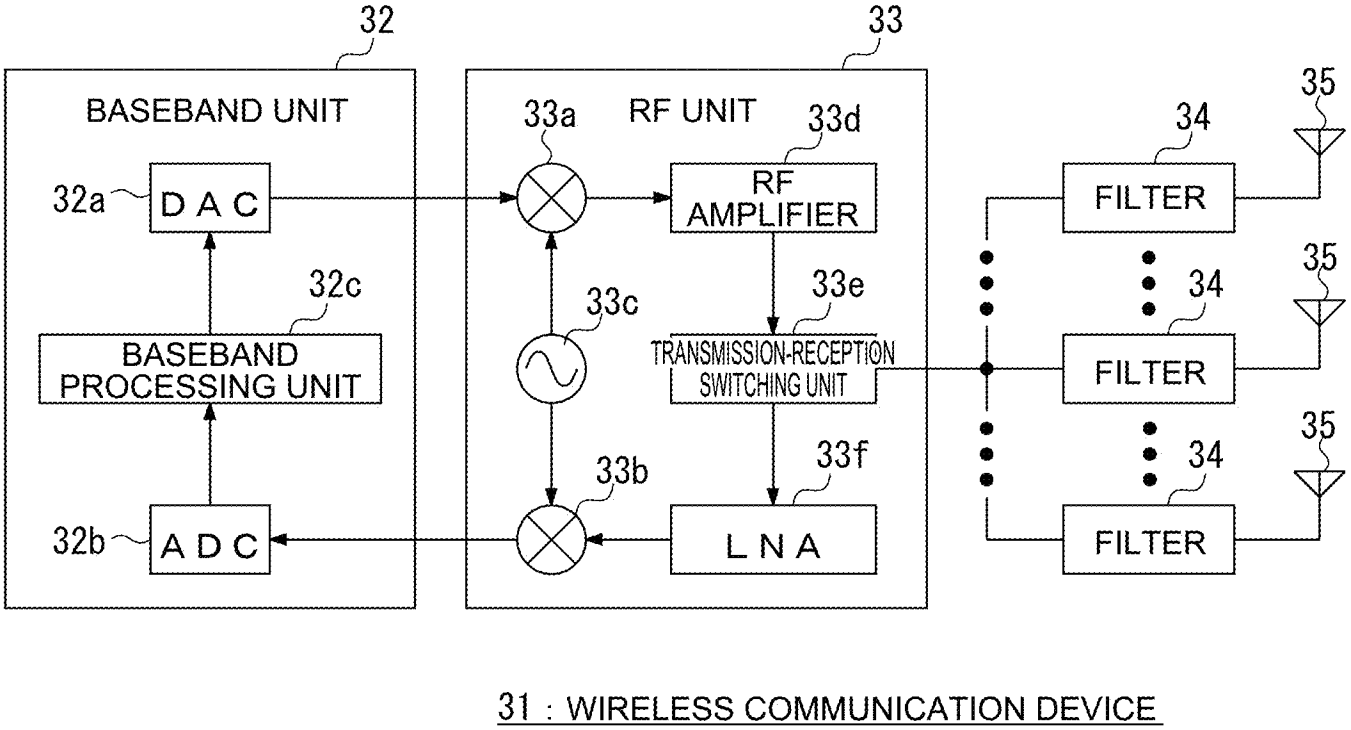
FIG. 17A is a block diagram illustrating a schematic configuration of a wireless communication device having a transmission function and a receiving function.

FIG. 17A is a block diagram illustrating a schematic configuration of a wireless communication system 31 having a transmission function and a reception function. The wireless communication system 31 in FIG. 17A includes a baseband unit 32, an RF unit 33, filters 34, and antennas 35. The wireless communication system 31 in FIG. 17A performs, for example, 5G wireless communication.

The baseband unit 32 performs modulation processing of a transmission signal to be transmitted by the antennas 35 and demodulation processing of a reception signal received by the antennas 35. Inside the baseband unit 32, a DAC 32*a* that converts a modulated transmission signal into an analog signal, an ADC 32*b* that converts a reception signal into a digital signal, and a baseband processing unit 32*c* that performs modulation processing and demodulation processing are provided. In a wireless transmitter having no reception function, the ADC 32*b* can be omitted.

Figure 17B:
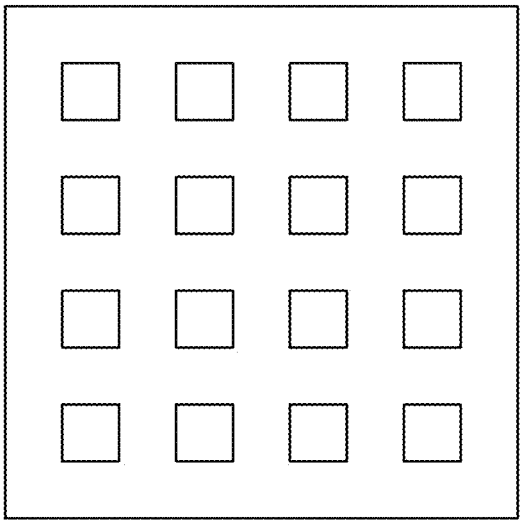
FIG. 17B is a plan view of an antenna.

The RF unit 33 includes a mixer 33*a* for converting a baseband signal subjected to modulation processing in the baseband unit 32 into a radio-frequency signal, a mixer 33*b* for converting a radio-frequency reception signal received by the antennas 35 into an intermediate frequency signal, a local oscillator 33*c*, an RF amplifier 33*d* for amplifying a radio-frequency signal for transmission, a low noise amplifier (LNA) 33*f* for amplifying a reception signal, and a transmission-reception switching unit 33*e* for switching transmission and reception by the antennas 35. As illustrated in the plan view in FIG. 17B, each of the antennas 35 may have a substrate on which a plurality of flat-plate shaped antenna elements (also referred to as patch antennas) are arranged vertically and horizontally. The antenna 35 in FIG. 17B is used by the wireless communication system 31 equipped with an adaptive impedance matching (AIM) system. The AIM system detects a user and a radio wave propagation state, and calculates and applies an optimum matching state suitable for the user and the radio wave propagation state.

Figure 17C:
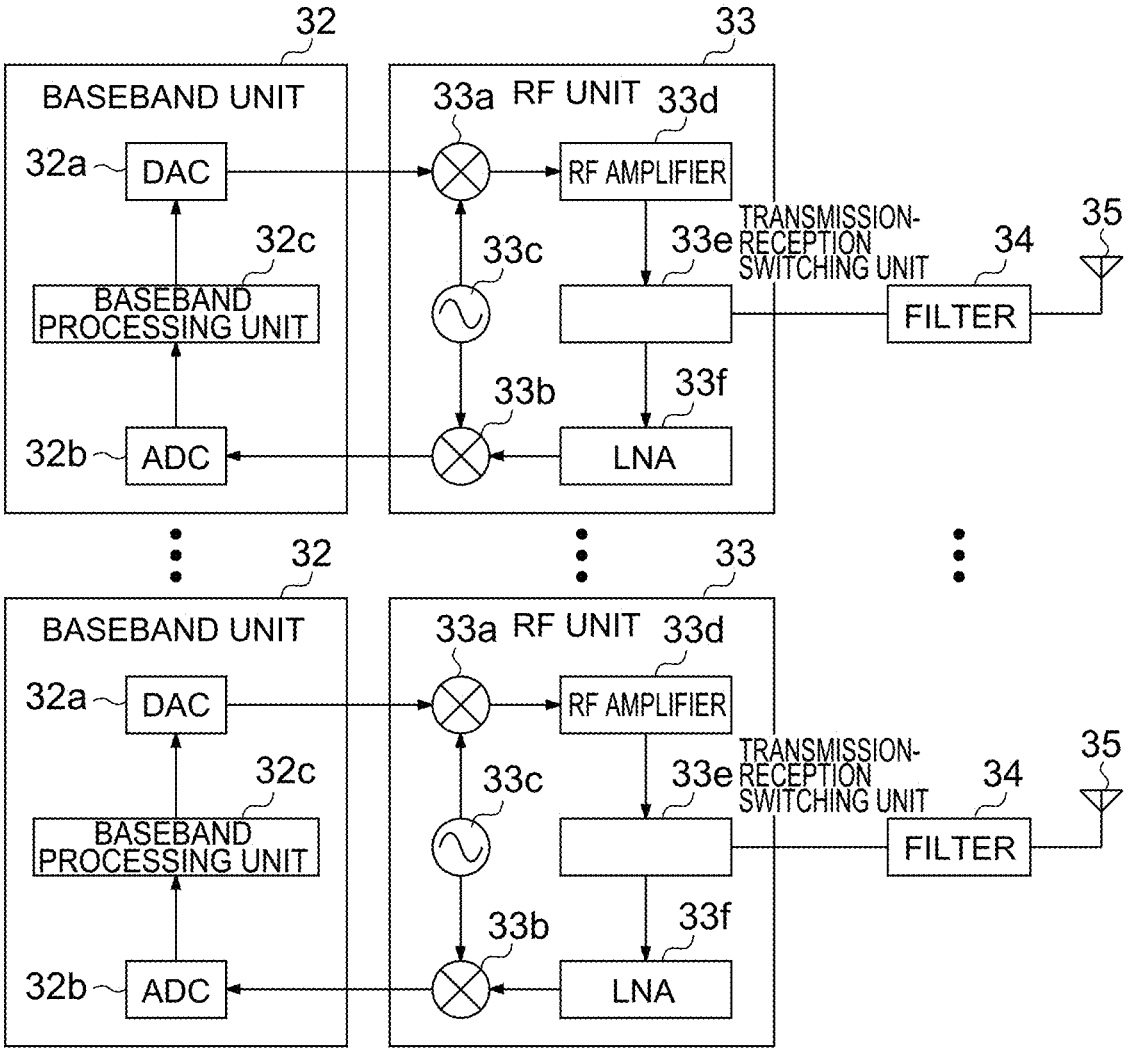
FIG. 17C is a block diagram illustrating a schematic configuration of a wireless communication device according to a modification.

FIG. 17C is a block diagram illustrating a schematic configuration of a wireless communication device 31*a* according to a modification. The wireless communication device 31*a* in FIG. 17C is an example in which the baseband unit 32, the RF unit 33, and the antenna 35 are in a 1:1 relationship, and a plurality of baseband units 32 and a plurality of RF units 33 corresponding to a plurality of antennas 35 are provided.

The filter 34 is connected between the RF unit 33 and the antenna 35. The filter 34 functions as a band rejection filter when transmitting a radio signal. A filter 34 functioning as a low-pass filter 34 when a radio signal is received by the antenna 35 may be provided. The filter 34 is provided corresponding to each patch antenna, and may be attached to each patch antenna.

As described above, in the filter 34 according to the present embodiment represented by the filters 11, 11*a*, 11*b*, 11*c*, and 11*d* of the first to fifth examples described above, the waveguide 12 of the waveguide structure 6, the reflective resonator 15, and the coupling portion 16 can be configured by forming the conductive vias 5 (the first conductive vias 5*a*, the third conductive vias 5*b*, and the fourth conductive via 5*c*) in the dielectric substrate 7, and therefore a small and thin band rejection filter can be manufactured while suppressing signal loss. Furthermore, frequency characteristics of the band rejection filter can be controlled by adjusting the position of the fourth conductive via 5*c* provided in the coupling portion 16, and therefore the frequency characteristics of the band rejection filter can be optimized.

Furthermore, by changing the positions of the third conductive vias 5*b* according to a frequency band to be cut off, the size, the number, and the place of the reflective resonator 3 can be changed, and a band rejection filter capable of cutting off a desired frequency band can be realized.

The band rejection filter according to the present embodiment can be reduced in size and thickness, and therefore can be attached to the patch antenna 35 used in 5G wireless communication, and interference with a frequency band adjacent to a frequency band used in 5G can be suppressed.

While certain embodiments have been described, these embodiments have been presented by way of example only, and are not intended to limit the scope of the disclosures. Indeed, the novel methods and systems described herein may be embodied in a variety of other forms; furthermore, various omissions, substitutions and changes in the form of the methods and systems described herein may be made without departing from the spirit of the disclosures. The accompanying claims and their equivalents are intended to cover such forms or modifications as would fall within the scope and spirit of the disclosures.

The invention claimed is:

1. A filter comprising:

a first conductive layer;

a second conductive layer; and a dielectric substrate located between the first conductive layer and the second conductive layer, wherein the dielectric substrate comprises:

a waveguide capable of propagating a radio-frequency signal in a first direction by a region between (1) a first conductive via group having first conductive vias passing through the dielectric substrate from the first conductive layer to the second conductive layer and spaced apart from each other along the first direction and (2) a second conductive via group having second conductive vias passing through the dielectric substrate from the first conductive layer to the second conductive layer and spaced apart from each other along the first direction, and a reflective resonator that is coupled to the waveguide in an electromagnetic field and reflects a signal in a predetermined frequency band in the radio-frequency signal propagating through the waveguide, and the reflective resonator comprises:

a third conductive via group having third conductive vias passing through the dielectric substrate from the first conductive layer to the second conductive layer and spaced apart from each other along a periphery of a region in contact with a defective part that is provided in a part of the first conductive via group and where no first conductive via group is provided, and one or more fourth conductive vias that pass through the dielectric substrate from the first conductive layer to the second conductive layer and are disposed in the defective part.

2. The filter according to claim 1, further comprising a coupling portion that couples the waveguide and the reflective resonator in an electromagnetic field via a coupling hole between the fourth conductive via and two first conductive vias of the first conductive via group at both ends of the defective part.

3. The filter according to claim 1, wherein the waveguide has a band rejection filter function of cutting off a signal in the predetermined frequency band in the radio-frequency signal input at the waveguide and outputting a signal in a frequency band other than the predetermined frequency band from the waveguide.

4. The filter according to claim 1, wherein the fourth conductive via is disposed within a predetermined range from a center position of the defective part.

5. The filter according to claim 1, wherein a length of the defective part in the first direction is wider than an interval between two adjacent first conductive vias of the first conductive via group in a portion other than the defective part.

6. The filter according to claim 1, wherein the third conductive via group comprises a fifth conductive via group having fifth conductive vias apart from one of the two first conductive vias of the first conductive via group at both ends of the defective part in a direction intersecting the first direction and a sixth conductive via group having sixth conductive vias apart from the other one of the two first conductive vias of the first conductive via group at both ends of the defective part in the direction intersecting the first direction.

7. The filter according to claim 6, wherein the third conductive via group comprises a seventh conductive via group located between ends of the fifth conductive via group and the sixth conductive via group and spaced apart from the fifth conductive via group and the sixth conductive via group.

8. The filter according to claim 7, wherein the reflective resonator resonates in a resonance mode having one peak of an electric field in a signal propagation direction; and the fourth conductive via is spaced apart from the fifth conductive via group by 4L/10 or more and is spaced apart from the sixth conductive via group by 4L/10 or more, where L is a length of the seventh conductive via group.

9. The filter according to claim 7, wherein the fourth conductive via is arranged within a range of ±L/5 or less in a second direction intersecting the first direction from a center position of the defective part, where L is a length of the seventh conductive via group.

10. The filter according to claim 7, wherein the reflective resonator resonates in a resonance mode having n peaks of an electric field in a signal propagation direction, n being an integer of 1 or more, and the n fourth conductive vias are provided in the defective part.

11. The filter according to claim 10, wherein the n fourth conductive vias are arranged within a range of ±L/(10×n) or less in a second direction intersecting the first direction from a center position of the defective part in the first direction, where L is a length of the seventh conductive via group.

12. The filter according to claim 1, wherein a length of the defective part in the first direction is determined by a correlation between a frequency and signal power of the radio-frequency signal propagating through the waveguide and a frequency and signal power of a signal reflected by the reflective resonator.

13. The filter according to claim 1, wherein the defective part comprises a plurality of defective parts arranged at a plurality of places of the first conductive via group so as to be spaced apart from each other; and the reflective resonator comprises a plurality of reflective resonators arranged from the plurality of defective parts in a second direction intersecting the first direction.

14. The filter according to claim 13, wherein two of the reflective resonators that are adjacent to each other in the first direction are arranged at an interval within a range of ±20% of a reference interval 3λg/4, where λg is a guide wavelength corresponding to a center frequency of band rejection.

15. The filter according to claim 14, wherein the reflective resonators are alternately arranged in the second direction from the first conductive via group and the second conductive via group.

16. The filter according to claim 15, wherein the reflective resonators alternately arranged in the second direction from the first conductive via group and the second conductive via group are arranged within a range of ±20% of a reference interval λg/4, where λg is a guide wavelength corresponding to a center frequency of band rejection.

17. The filter according to claim 14, wherein the reflective resonators are arranged symmetrically in the second direction from the first conductive via group and the second conductive via group.

18. The filter according to claim 1, wherein the dielectric substrate comprises a plurality of stacked dielectric substrates;

the first conductive layer and the second conductive layer are disposed on two opposing surfaces of each of the plurality of dielectric substrates, and the reflective resonator, the first conductive via group, and the second conductive via group are arranged in each of the plurality of dielectric substrates.

19. The filter according to claim 18, wherein the waveguides formed in the respective plurality of dielectric substrates are disposed so as to overlap each other in a stacking direction; and the reflective resonators in the plurality of dielectric substrates are disposed at different positions in the stacking direction.

20. A wireless communication system comprising:

a signal generator that generates a radio-frequency signal;

a filter that cuts off a signal in a predetermined frequency band included in the radio-frequency signal and allows passage of a signal in a frequency band other than the predetermined frequency band; and an antenna that radiates a radio wave according to a radio-frequency signal that has passed through the filter, wherein the filter comprises:

a first conductive layer, a second conductive layer, and a dielectric substrate located between the first conductive layer and the second conductive layer, the dielectric substrate comprises:

a waveguide capable of propagating a radio-frequency signal in a first direction by a region between (1) a first conductive via group having first conductive vias passing through the dielectric substrate from the first conductive layer to the second conductive layer and spaced apart from each other along the first direction and (2) a second conductive via group having second conductive vias passing through the dielectric substrate from the first conductive layer to the second conductive layer and spaced apart from each other along the first direction, and a reflective resonator that is coupled to the waveguide in an electromagnetic field and reflects a signal in a predetermined frequency band in the radio-frequency signal propagating through the waveguide, and the reflective resonator comprises:

a third conductive via group having third conductive vias passing through the dielectric substrate from the first conductive layer to the second conductive layer and spaced apart from each other along a periphery of a region in contact with a defective part that is provided in a part of the first conductive via group and where no first conductive via group is provided, and one or more fourth conductive vias that pass through the dielectric substrate from the first conductive layer to the second conductive layer and are disposed in the defective part.

* * * * *